US007824281B1

(12) United States Patent
Peterson

(10) Patent No.: US 7,824,281 B1
(45) Date of Patent: Nov. 2, 2010

(54) METHOD FOR USING A WEDGE TO IMPROVE A GOLFER'S SWING

(75) Inventor: Randolph J. Peterson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 12/629,590

(22) Filed: Dec. 2, 2009

Related U.S. Application Data

(60) Provisional application No. 61/140,222, filed on Dec. 23, 2008.

(51) Int. Cl.
*A63B 69/36* (2006.01)

(52) U.S. Cl. ..... 473/409; 473/219; 473/266

(58) Field of Classification Search ..... 473/207, 473/218, 219, 266, 269, 270, 278, 279, 409, 473/422

See application file for complete search history.

(56) References Cited

U.S. PATENT DOCUMENTS

| | | | | |
|---|---|---|---|---|
| 3,195,891 | A * | 7/1965 | Rogers | 473/217 |
| 3,915,457 | A * | 10/1975 | Casey | 473/267 |
| 4,322,084 | A * | 3/1982 | Reece et al. | 473/273 |
| 5,263,863 | A * | 11/1993 | Stefani et al. | 473/269 |
| 7,429,222 | B2 | 9/2008 | Tolson | |
| 7,568,979 | B2 | 8/2009 | Arnold, Jr. | |
| 7,572,192 | B1 | 8/2009 | Boyd | |
| 7,597,632 | B2 | 10/2009 | Edwards et al. | |
| 7,722,473 | B1 * | 5/2010 | Shah | 473/218 |

* cited by examiner

*Primary Examiner*—Nini Legesse
(74) *Attorney, Agent, or Firm*—Michael A. Catania

(57) ABSTRACT

A method for improving a golfer's swing using a training wedge composed of a rubberized foam and having an angled surface to force a golfer to have a steeper angle of attack.

2 Claims, 4 Drawing Sheets

METHOD FOR USING A WEDGE TO IMPROVE A GOLFER'S SWING

CROSS REFERENCES TO RELATED APPLICATIONS

The present application claims priority to U.S. Provisional Patent Application No. 61/140,222, filed on Dec. 23, 2008.

STATEMENT REGARDING FEDERALLY SPONSORED RESEARCH OR DEVELOPMENT

Not Applicable

BACKGROUND OF THE INVENTION

1. Field of the Invention

The present invention relates to a method for improving a golfer' swing.

2. Description of the Related Art

The prior art discloses various training aids. One such example is U.S. Pat. No. 7,597,632 for Gold Putting Practice Aid which discloses an apparatus for guiding stroking movement of a putter, comprising a base frame engageable with and forming a border about a putting surface in an operative stroke practice position.

Another example is U.S. Pat. No. 7,572,192 issued to Boyd for Golf Swing Training Aid. This patent discloses the use of a "C"-shaped head rest that is positioned across the user's forehead and padded for comfort. The headrest is connected to an extendable shaft that varies in length from 4 feet long to 7 feet long. The headrest trains the golfer to maintain a proper head position during a golf swing.

Yet another example is U.S. Pat. No. 7,568,979 for Golf Swing Training Apparatus which discloses a mounting bar with an extendable length arm stabilizer extending outwardly from the mounting bar and terminating in a headrest.

Tolson, U.S. Pat. No. 7,429,222 for a Parallel Putting Device And Method discloses a putting aid using device to maintain the position of the putter during the putt.

The prior art fails to provide a chipping training aid that constrains wrist cupping. Further the prior art devices fail to constrain golf club head movement, which is a critical parameter in chipping success.

Golfers that experience problems with chipping tend to scoop at the ball and try to lift it up into the air, which usually results in the golfer hitting behind the ball or skulling the golf ball. Essentially, the low point of the golfer's swing arc is behind the golf ball, not in front of the golf ball where the low point should be for a proper chipping technique.

BRIEF SUMMARY OF THE INVENTION

The main objective of the method of the present invention is to give golfers with chipping difficulties the ability to understand and achieve proper angle of attack with the golf club head. The method of the present invention uses a training wedge to instruct golfers on proper chipping in order to force the golfer to locate the low point of the golfer's swing arc in front of the golf ball.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
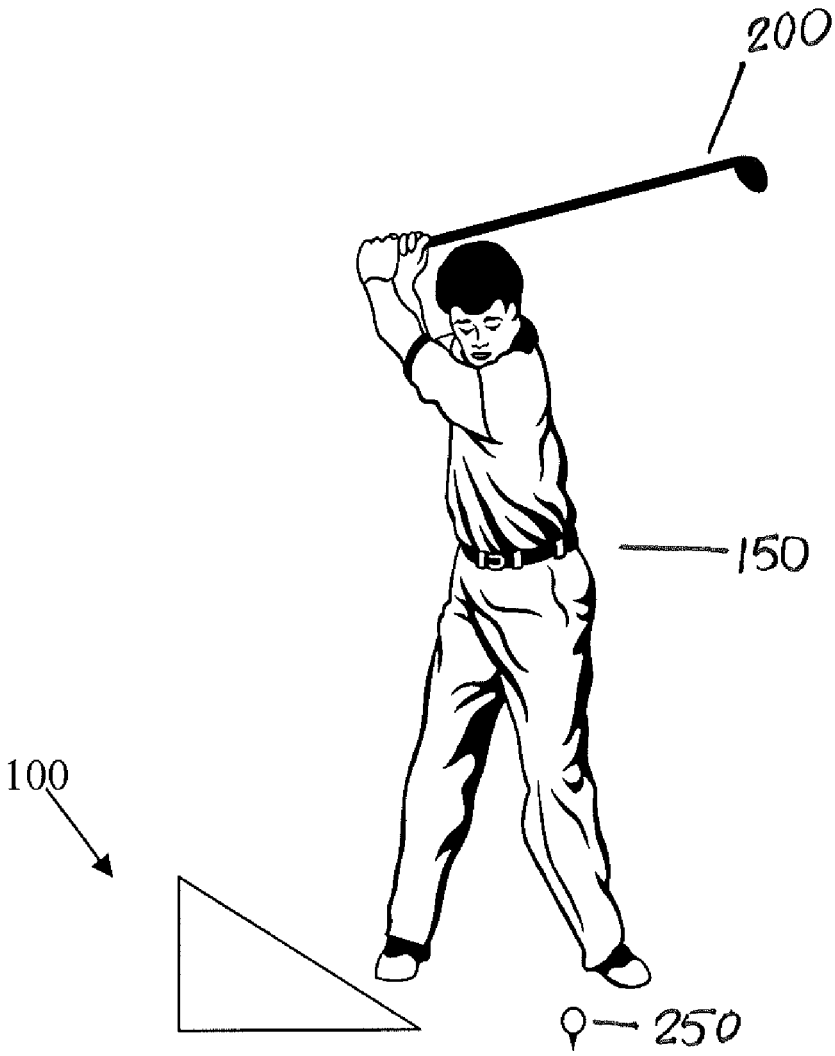
FIG. 1 is a view of a golfer using a training wedge in practicing the method of the present invention.
Figure 2:
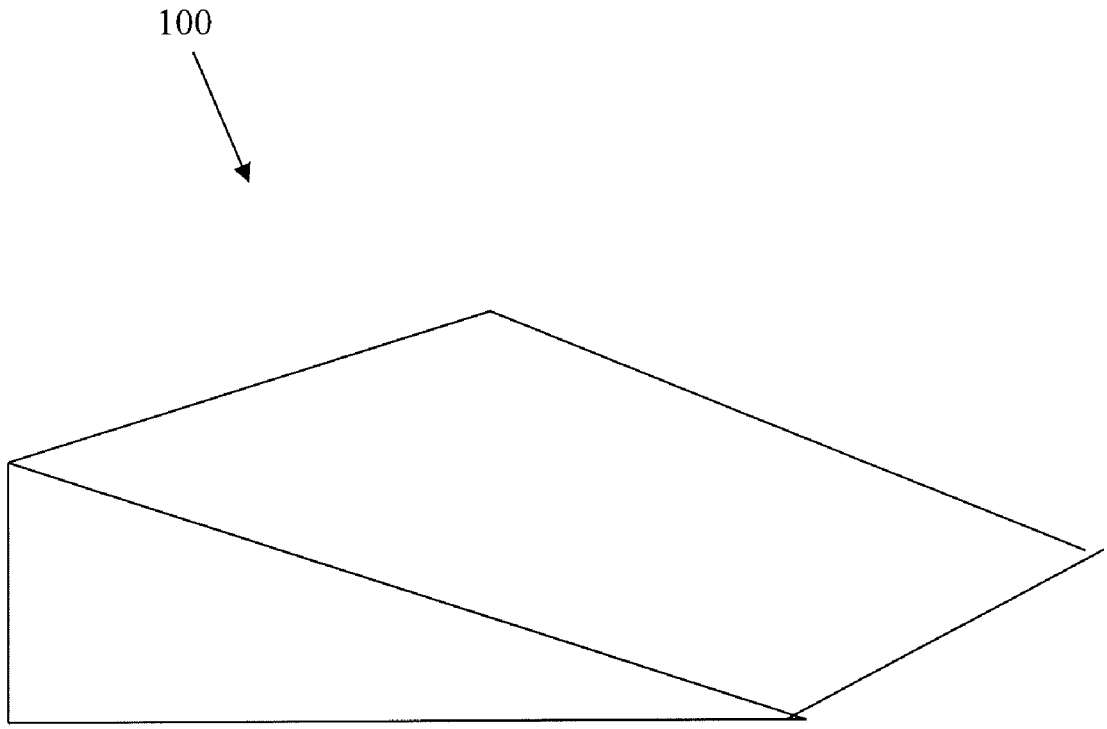
FIG. 2 is a perspective view of a training wedge.
Figure 3:
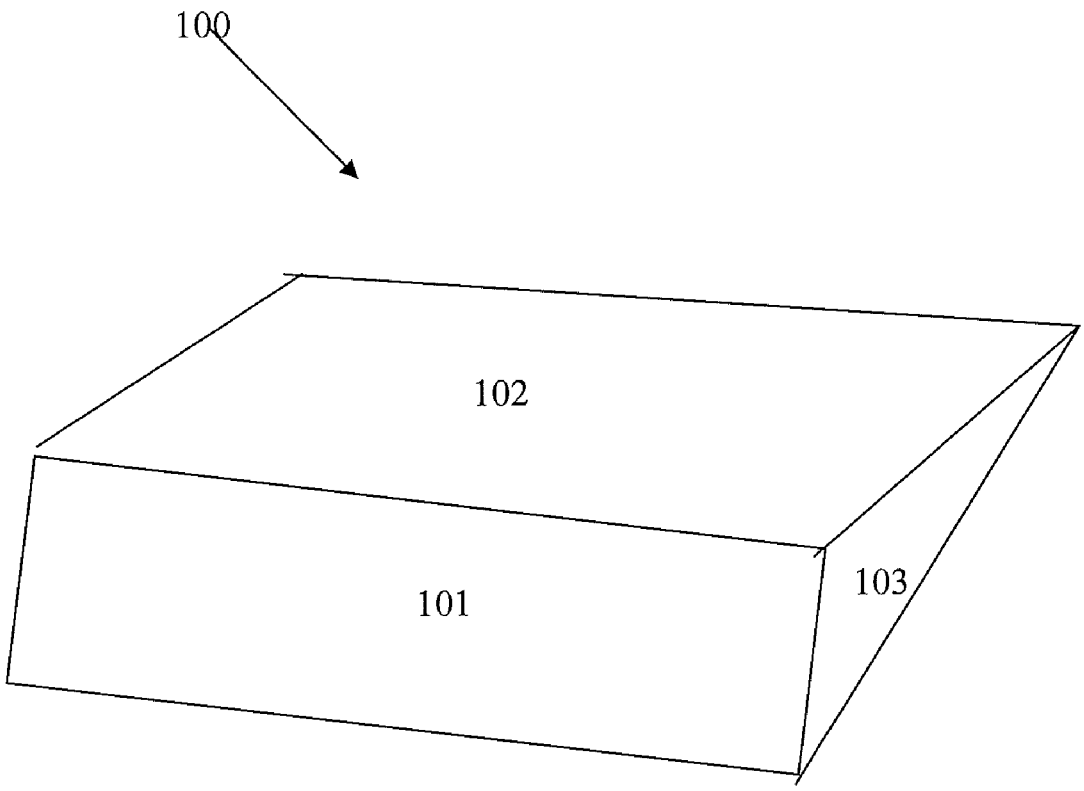
FIG. 3 is a rear view of a training wedge illustrating a rectangular wall, triangular side wall and angled surface of the training wedge.
Figure 4:
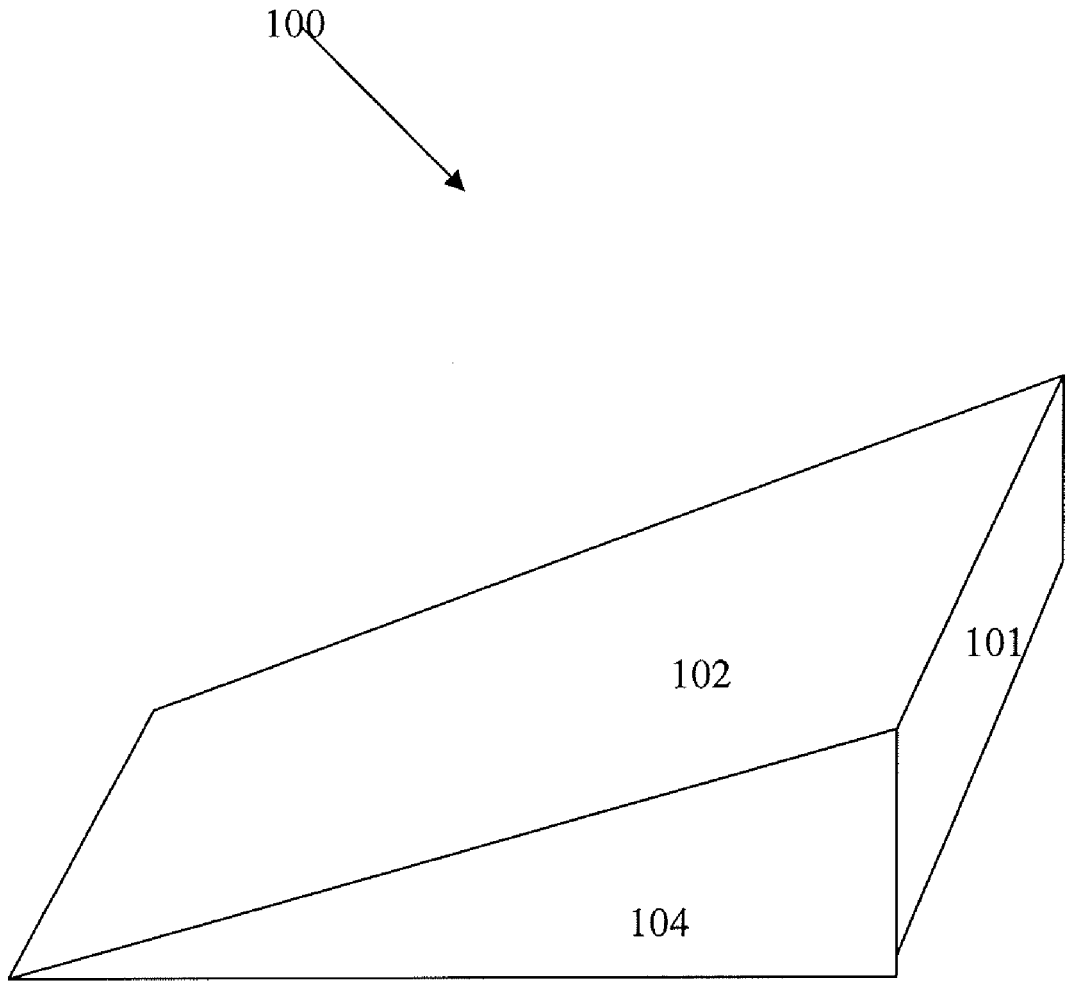
FIG. 4 is a side perspective view of a training wedge.

As shown in the figures, a training wedge 100 is used to improve a golfer's 150 swing.

The wedge 100 preferably has a dimension of 0.125 inch to 3.375 inches in height, a width of 11.375 inches and a length of 12.25 inches. Ranges of greater than or lesser than 20% of these height, width and length dimensions are preferred and ranges of greater than or lesser than 10% of these height, width and length dimensions are most preferred.

The training wedge 100 preferably has a body with an angled surface 102, a rectangular wall 101, a first triangular side wall 103, a second triangular side wall 104 and a flat bottom surface 105, not shown.

The dimensions of the training wedge 100 ensure that the golfer has a steep takeaway which is helpful in returning the golf club head properly.

The wedge 100 is placed under a right-handed golfer's 150 left foot during a swing. The wedge 100 is preferably composed of a rubberized foam material and preferably weighs about 4 to 6 pounds.

The low end of the training wedge 100 is preferably placed behind the golf ball 250, about a grip's length behind the golf ball 250. During a golf swing, the golf club 200 head must clear the high end of the training wedge 100 during a steep angle of attack toward the golf ball 250. If the golf club 200 approaches too shallow during the swing, the golf club head 200 will strike the training wedge 100 and force the golfer 150 to swing more steeply.

The method along with the training wedge 100 allows a golfer 150 to develop swing path consistency through forcing a steeper angle of attack.

The training wedge 100 is alternatively placed in front of a golf ball 250 to be struck by a golfer 150 to improve the golfer's 150 lob shots, or shots that are hit higher in the air. The training wedge 100 helps the golfer 150 sweep the golf ball 250 during a lob shot and miss the training wedge 100 in front of the golf ball 250. The training wedge allows the golfer 150 to perfect a more sweeping golf swing arc for the lob shots.

The training wedge 100 is alternatively used to assist the golfer 150 in proper weight distribution during a golf swing. In this method, the golfer 150 places a back foot on the training wedge 100. Most amateur golfers 150 move their weight to the heel of their right foot during a golf swing and then turn their hips and move their weight to the heel of their left foot on the down swing. This action routes the golf club 200 to the outside resulting in the golf club 200 coming across the golf ball 250. By placing the right foot of a right handed golfer 150 on the training wedge 100, with the low end of the training wedge 100 facing the golfer 150, the golfer 150 is forced to place weight on the right heel resulting in better weight distribution during the back swing. Next, the training wedge 100 is placed under the front left foot with the low end at the toe of the golfer 150 and the high end at the heel of the golfer 150 to improve the weight distribution of the follow-through.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A method for improving a golfer's golf swing, the method comprising:

placing a wedge approximately a grip length behind a golf ball to be struck with a golf club, the wedge comprising a body having an angled surface, a flat surface, a rectangular wall, a first triangular side wall and a second triangular side wall, the wedge composed of a rubberized foam material, the wedge having a height ranging from 0.125 inch to 3.375 inches, and a width ranging from 11.375 inches and a length of 12.25 inches; and swinging a golf club in a manner to avoid hitting the wedge with the golf club while striking the golf ball with the golf club;

wherein the dimensions of the training wedge ensure that the golfer has a steep takeaway during the golfer's golf swing and the training wedge allows a golfer to develop swing path consistency through forcing a steeper angle of attack for a golf swing.

2. A method for improving a golfer's golf swing, the method comprising:

placing a wedge approximately a grip length in front of a golf ball to be struck with a golf club, the wedge comprising a body having an angled surface, a flat surface, a rectangular wall, a first triangular side wall and a second triangular side wall, the wedge composed of a rubberized foam material, the wedge having a height ranging from 0.125 inch to 3.375 inches, and a width ranging from 11.375 inches and a length of 12.25 inches; and swinging a golf club in a manner to avoid hitting the wedge with the golf club while striking the golf ball with the golf club;

wherein the dimensions of the training wedge ensure that the golfer has a steep takeaway during the golfer's golf swing and training wedge helps the golfer sweep the golf ball during a lob shot and miss the training wedge in front of the golf ball to assist the golfer perfect a more sweeping golf swing arc for the lob shots.

* * * * *